US008216097B2

(12) United States Patent
Nick et al.

(10) Patent No.: US 8,216,097 B2
(45) Date of Patent: Jul. 10, 2012

(54) DETACHABLE TRACKABLE ARROW NOCK

(76) Inventors: Jacob S. Nick, Brookwood, AL (US); Philip M. Nader, Jr., Northport, AL (US)

( * ) Notice: Subject to any disclaimer, the term of this patent is extended or adjusted under 35 U.S.C. 154(b) by 73 days.

(21) Appl. No.: 12/731,452

(22) Filed: Mar. 25, 2010

(65) Prior Publication Data

US 2010/0248871 A1 Sep. 30, 2010

Related U.S. Application Data

(60) Provisional application No. 61/163,513, filed on Mar. 26, 2009.

(51) Int. Cl.
*F42B 6/04* (2006.01)
*F42B 6/06* (2006.01)

(52) U.S. Cl. ..... 473/586; 473/578

(58) Field of Classification Search ..... 473/578, 473/585, 586

See application file for complete search history.

(56) References Cited

U.S. PATENT DOCUMENTS 4,421,319 A 12/1983 Murphy
5,157,405 A 10/1992 Wycoff et al.
6,059,677 A 5/2000 Breshears
6,612,947 B2 9/2003 Porter
6,764,420 B2 7/2004 Cyr et al.
6,814,678 B2 11/2004 Cyr et al.
6,856,250 B2 2/2005 Hilliard
7,232,389 B2 6/2007 Monteleone
2003/0176245 A1 * 9/2003 Cyr et al. ..... 473/578
2005/0231362 A1 10/2005 Pridmore, Jr. et al.
2006/0097882 A1 5/2006 Brinkerhoff et al.
2007/0105668 A1 5/2007 Kikos
2008/0248904 A1 10/2008 Cyr et al.
2010/0035709 A1 * 2/2010 Russell et al. ..... 473/570

* cited by examiner

*Primary Examiner* — John Ricci
(74) *Attorney, Agent, or Firm* — Kenneth M. Bush; Bush Intellectual Property Law

(57) ABSTRACT

A detachable, trackable arrow nock, comprising a proximal end for detachably coupling to a hollow distal end of an arrow shaft, a distal end for receiving a bow string, a plurality of fins for engaging the hide of an animal to prevent the nock from penetrating the hide, an electronic tracking device, and an anchor tethered to the nock, wherein the anchor is positioned within the hollow distal end of the arrow shaft when the proximal end of the nock is coupled to the distal end of the arrow shaft. As the arrow shaft moves through the animal, the nock is operable to detach from the arrow shaft when the fins engage the hide of the animal and the anchor is operable to engage internal tissues of the animal to secure the nock to the animal.

10 Claims, 3 Drawing Sheets

DETACHABLE TRACKABLE ARROW NOCK

CROSS-REFERENCE TO RELATED PATENT APPLICATION

The present application claims priority to U.S. Provisional Patent Application No. 61/163,513, filed Mar. 26, 2009, the disclosure of which is incorporated herein by reference.

FIELD OF THE INVENTION

The present invention relates to hunting arrows and, more particularly, to a hunting arrow that provides a means for tracking an animal after it has been shot by the arrow.

BACKGROUND OF THE INVENTION

There are occasions when a hunting arrow is embedded in an animal or passes through an animal without an immediate kill. Under these conditions it may not be possible to locate the wounded animal. To solve this problem, various trackable arrows have been developed that include an embedded transmitter which can transmit audio, visual, and/or radio frequency signals to allow a hunter to locate the animal. Because it is necessary for the transmitter to remain attached to the animal, various systems have been developed to secure the transmitter to the animal.

One such system is the use of detachable arrow nocks having a transmitter embedded within the nock. The nock includes hooks or barbs that embed into the animal hide as the arrow passes into and possibly through the animal. As the hooks embed into the animal hide, the nock detaches from the arrow shaft and remains attached to the hide. A problem with these hooks is that they may not always engage the hide effectively, in which case the nock may become dislodged from the hide as the wounded animal moves through underbrush, bushes, and tree branches. In addition, the use of hooks on the exterior of the nock presents a risk of injury to the hunter who can inadvertently be impaled by the hooks.

What is needed is an arrow having a detachable, trackable nock in which the nock can be internally anchored to the animal and without exposing the hunter to the anchoring mechanism.

SUMMARY OF THE INVENTION

The present invention is a detachable, trackable arrow nock for use with a hunting arrow, wherein the arrow comprises a shaft having a proximal end with an arrow head secured thereto and a hollow distal end. The nock comprises a proximal end for detachably coupling to the hollow distal end of the arrow shaft, a distal end for receiving a bow string, a plurality of fins for engaging the hide of an animal to prevent the nock from penetrating the hide, an electronic tracking device, and an anchor tethered to the nock, wherein the anchor is positioned within the hollow distal end of the arrow shaft when the proximal end of the nock is coupled to the distal end of the arrow shaft. The arrow preferably further comprises fletching attached to the shaft, wherein the fins of the nock are aligned with the fletching to promote proper flight of the arrow. As the arrow moves through the animal, the nock is operable to detach from the arrow shaft when the fins engage the hide of the animal and the anchor is operable to engage internal tissues of the animal to secure the nock to the animal.

These and other features of the invention will become apparent from the following detailed description of the invention.

DETAILED DESCRIPTION OF THE INVENTION

Figure 1:
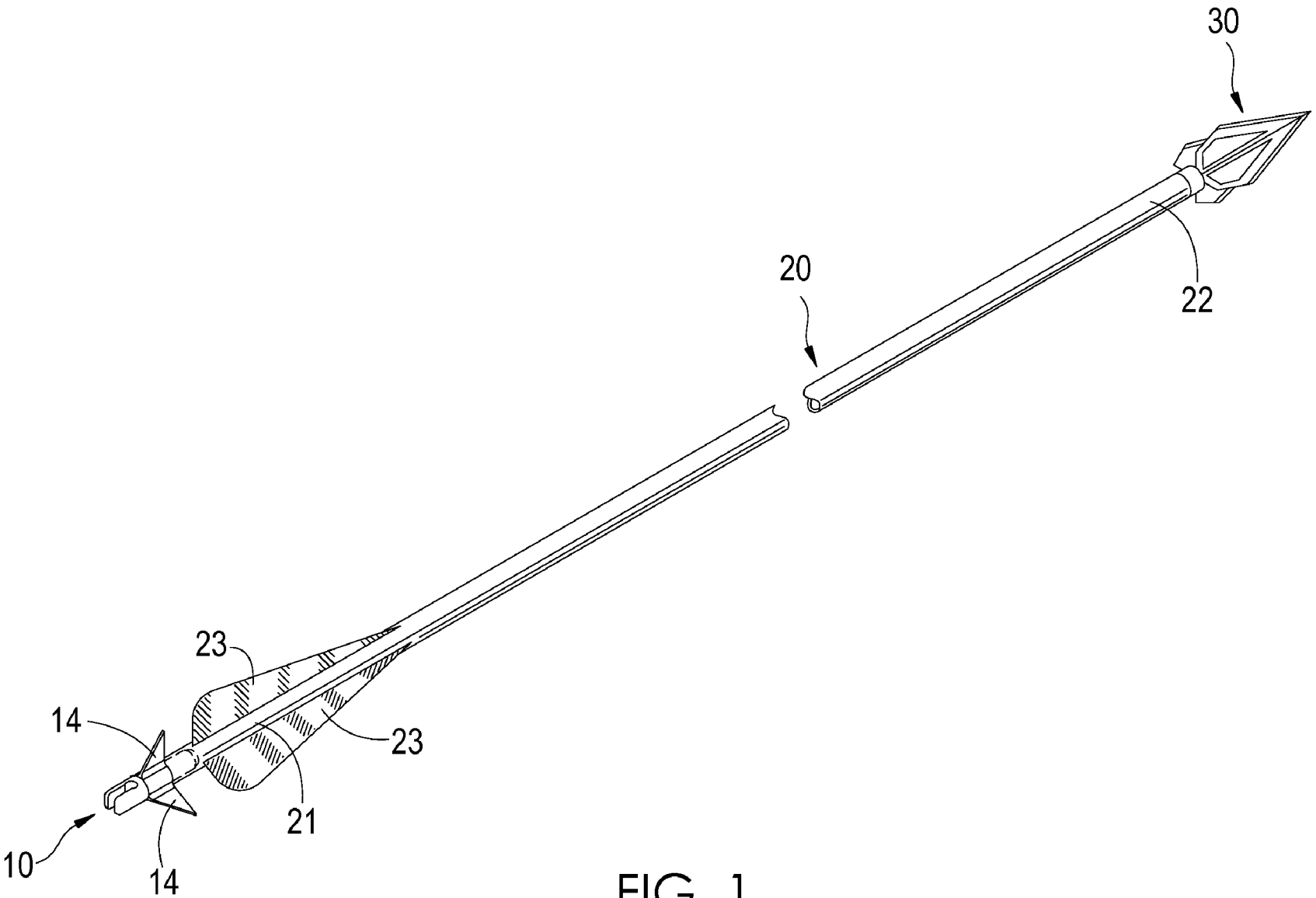
FIG. 1 is a perspective view of a hunting arrow having the nock of the present invention secured thereto.
Figure 2:
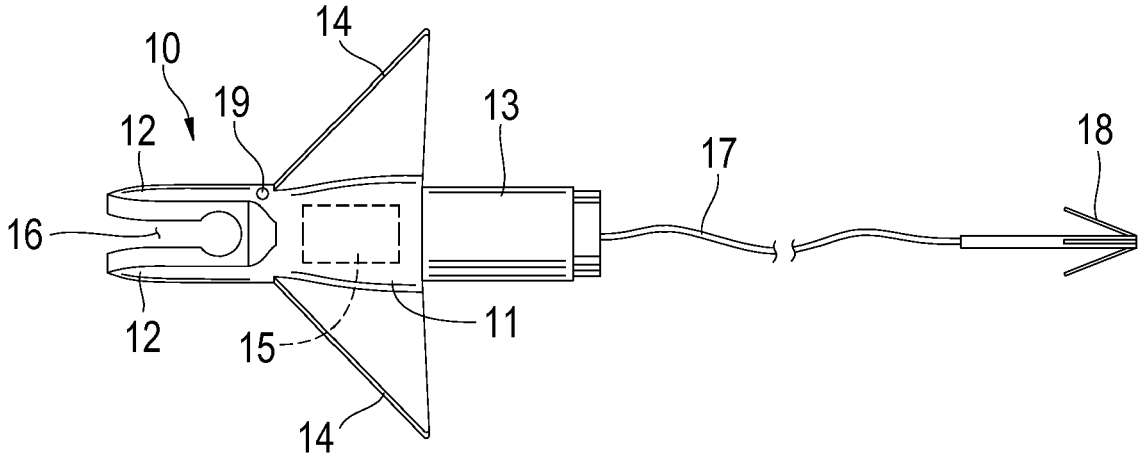
FIG. 2 is a side elevational view showing the nock of the present invention with an anchor tethered thereto.
Figure 3:
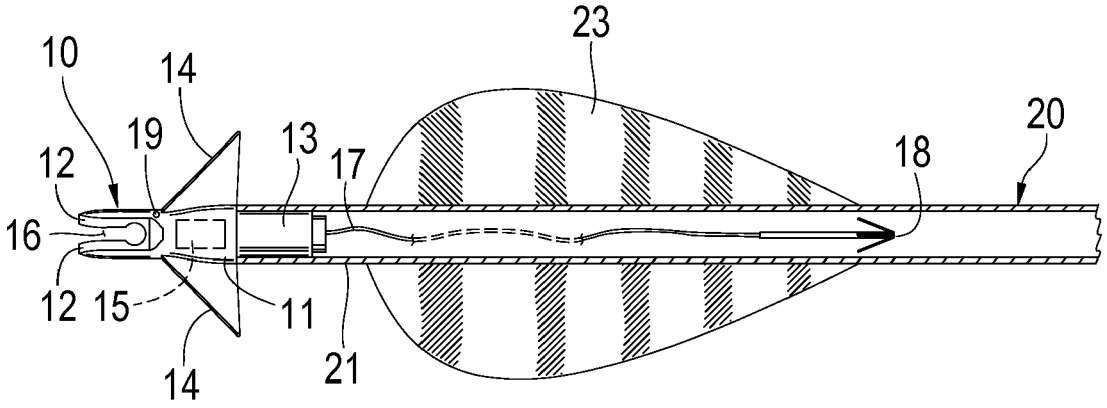
FIG. 3 is a side sectional view showing the nock and attached anchor of FIG. 2 secured within the distal end of an arrow shaft.
Figure 4:
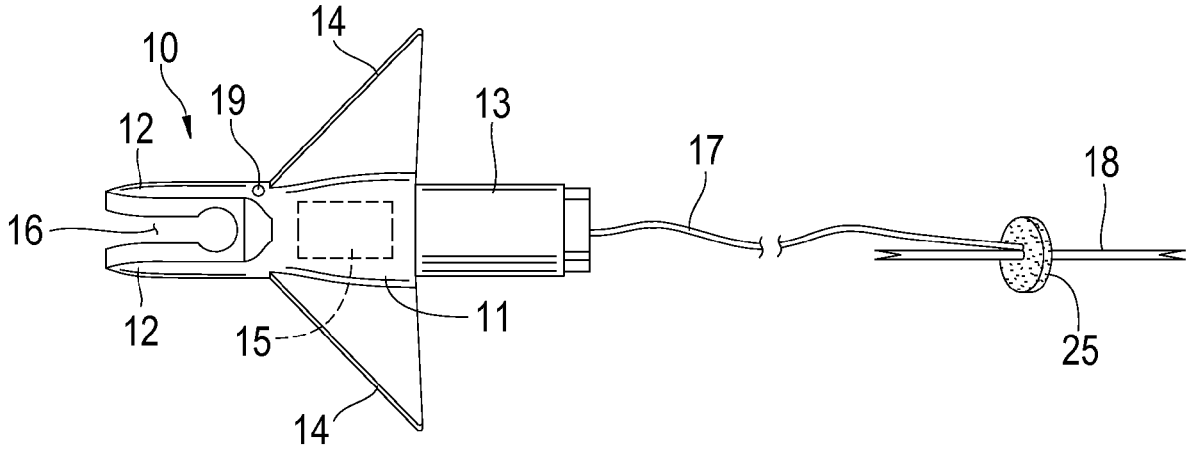
FIG. 4 is a side elevational view showing the nock of the present invention with an alternate anchor tethered thereto.
Figure 5:
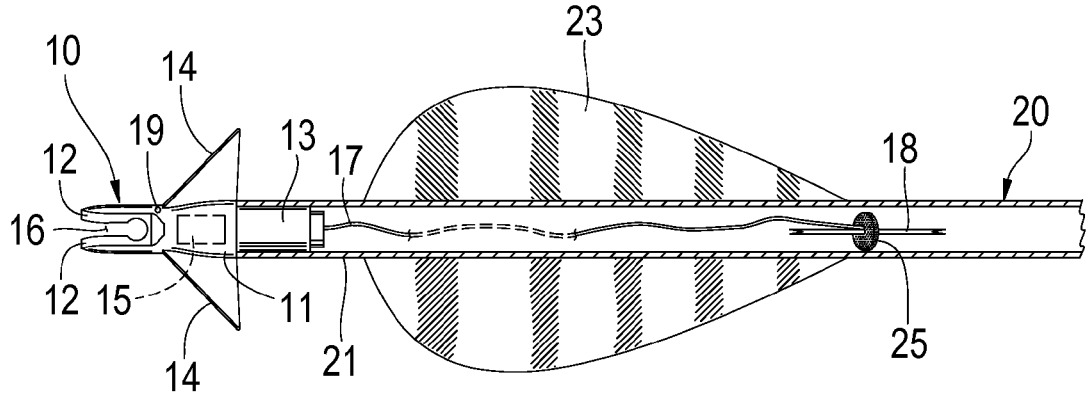
FIG. 5 is a side sectional view showing the nock and attached anchor of FIG. 4 secured within the distal end of an arrow shaft.

The preferred embodiments of the present invention are shown in FIGS. 1-5, wherein the invention comprises a detachable, trackable arrow nock 10 for use with a hunting arrow, wherein the arrow comprises a shaft 20 having a hollow distal end 21 and a proximal end 22 having an arrow head 30 secured thereto. The nock 10 comprises a base 11 with a distal end having opposing flanges 12 and a proximal end having an extension 13. The base 11 has a plurality of fins 14 extending therefrom which prevent the base 11 from penetrating the hide of an animal. Preferably, the base 11 has 3 fins 14 aligned directly in-line with the arrow's fletching 23 to promote proper flight of the arrow. The base 11 houses an electronic tracking device 15. The flanges 12 form a notch 16 for receiving a bow string of a bow. A distal end of a tether 17 is secured to the nock 10. The proximal end of the tether 17 is secured to an anchor 18 designed to engage the internal tissues of an animal and thus be retained within the animal. Examples of suitable anchors 18 include a spring-loaded multi-pronged hook, shown in FIGS. 2 and 3, or a spiked rod, shown in FIGS. 4 and 5, the latter preferably including a foam spacer 25. The extension 13 can be solid or hollow and can be fixed to base 11 or reversibly insertable into base 11. Extension 13 is reversibly insertable into the hollow distal end 21 of arrow shaft 20, and is retained in the arrow shaft 20 by friction until the fins 14 engage the hide of an animal, thereby preventing the nock 10 from further forward movement while the arrow shaft 20 continues to move forward through the animal.

An electronic tracking device 15 can be positioned permanently or reversibly within base 11. Any type of radio frequency transmitter well-known in the art may be used for this purpose. Any type of signaling devices well-known in the art, for example those which use audible or visual signals, may be used. The electronic tracking signaling or transmitter device may be activated by a switch 19 on base 11 or may be activated manually prior to reversible insertion of the tracking device 15 within base 11. In cases where a radio frequency transmitter is used, the receiver for the transmitter can be used to manually activate the transmitter before or after the arrow has been shot. The tracking device 15 may also be activated by the separation of the nock 10 from the arrow shaft 20. A battery can be used to power the tracking device 15.

As an example, a signaling device is disclosed in U.S. Pat. No. 4,421,319 to Murphy. This device uses a buzzer powered by a battery through an electric circuit. The buzzer is activated by a switch on the nock, and the electric circuit has a time delay function which can delay the buzzer from sounding for two or three minutes after the switch as been turned on. A video signal, such as a flashing light, may also be used. As another example, a transmitter-receiver system is disclosed in U.S. Patent Application Publication No. 2007/0105668 to Kikos. A transmitter within the chamber of a nock includes a microchip and a battery with appropriate electrical circuitry. The nock housing is made of electrically non-conductive material, such as plastic polymeric material, preferably transparent. The microchip can include a global positioning system unit for determining the location coordinates of the nock. The microchip also contains circuitry that facilitates wireless communication with a remote source, i.e., a receiver carried by a hunter. The transmitter, once loaded in the nock chamber, is in an active state and sends radio frequency signals to the receiver.

In further detail, the nock 10 is attached to arrow shaft 20 at the distal end 21 near the fletching 23. The tether 17 is attached to nock 10 and extends down the interior of the hollow arrow shaft 20 to position the anchor 18 within the hollow interior of shaft 20. Nock 10 is attached to arrow shaft 20 by placing extension 13 reversibly into the distal end 21 of shaft 20. Extension 13 is held in place within shaft 20 by friction. In use, the transmitter or signaling device 15 is activated before or after shooting the arrow, or is activated automatically when nock 10 is detached from the distal end 21 of shaft 20 when the arrow penetrates the animal. After the arrow is shot, the nock 10 will separate from the distal end 21 of shaft 20 when fins 14 engage the hide of the animal, causing nock 10 to stop moving forward; however, the arrow will continue moving through the animal. As a result, the anchor 18 will exit the interior of the shaft 20 and will become embedded in the tissue of the animal if any force is applied to nock 10 to pull nock 10 away from the hide of the animal. Anchor 18 will, therefore, anchor into the tissue and prevent nock 10 from becoming detached from the animal. The transmitter or signaling device 15 will allow the hunter to locate the nock 10 and, thus, locate the animal. The nock can be tracked from the signals emitted from the signaling or transmitting device 15 located within the nock base 11.

While the invention has been shown and described in some detail with reference to specific exemplary embodiments, there is no intention that the invention be limited to such detail. On the contrary, the invention is intended to include any alternative or equivalent embodiments that fall within the spirit and scope of the invention as described above and as recited in the appended claims.

The invention claimed is:

1. A detachable, trackable arrow nock, comprising:

a proximal end for detachably coupling to a hollow distal end of an arrow shaft;

a distal end for receiving a bow string;

a plurality of fins for engaging the hide of an animal to prevent said nock from penetrating the hide;

an electronic tracking device; and an anchor tethered to said nock, wherein said anchor is positioned within the hollow distal end of the arrow shaft when said proximal end of said nock is coupled to the distal end of the arrow shaft;

wherein said nock is operable to detach from the arrow shaft when said fins engage the hide of the animal as the arrow shaft moves through the animal;

wherein said anchor is operable to engage internal tissues of the animal to secure said nock to the animal; and wherein said anchor is a spiked rod.

2. An arrow nock according to claim 1, further comprising a foam spacer secured about said rod.

3. A hunting arrow, comprising:

a shaft having a proximal end and a distal end, wherein said distal end of said shaft is hollow;

an arrow head secured to said proximal end of said shaft;

a nock detachably secured to said distal end of said shaft, wherein said nock comprises a distal end for receiving a bow string, a proximal end for detachably coupling to said distal end of said shaft, a plurality of fins for engaging the hide of an animal to prevent said nock from penetrating the hide, and an electronic tracking device; and an anchor tethered to said nock, wherein said anchor is positioned within said hollow distal end of said shaft when said proximal end of said nock is coupled to said distal end of said shaft;

wherein said nock is operable to detach from said shaft when said fins engage the hide of the animal as said shaft moves through the animal;

wherein said anchor is operable to engage internal tissues of the animal to secure said nock to the animal; and wherein said anchor is a spiked rod.

4. A hunting arrow according to claim 3, further comprising fletching attached to said distal end of said shaft, wherein said fins are aligned with said fletching to promote proper flight of said arrow.

5. A hunting arrow according to claim 3, further comprising a foam spacer secured about said rod.

6. A method of securing a tracking device to a game animal using a hunting arrow, comprising the steps of:

a) inserting an anchor into a hollow distal end of an arrow shaft, wherein said anchor is connected to a proximal end of an arrow nock with a tether, wherein said arrow shaft has a proximal end having an arrow head secured thereto;

b) inserting said proximal end of said arrow nock into said distal end of said arrow shaft such that said arrow nock is detachably secured to said distal end of said arrow shaft, wherein said nock comprises a distal end for receiving a bow string, a plurality of immovable fins for engaging the hide of the animal to prevent said nock from penetrating the hide, and an electronic tracking device operable to transmit a trackable signal; and c) shooting said arrow into the animal such that said arrow head and said arrow shaft pass through the hide of the animal and through internal tissues of the animal, wherein said nock completely detaches from said arrow shaft when said fins engage the hide of the animal and thereby allows said arrow head and said arrow shaft to continue passing through the animal, wherein said tether withdraws said anchor from said arrow shaft as said arrow shaft passes through said animal, and wherein said anchor engages internal tissues of the animal and thereby secures said nock to the animal.

7. A method according to claim 6, wherein said anchor is a spring-loaded multi-pronged hook.

8. A method according to claim 6, wherein said anchor is a spiked rod.

9. A method according to claim 8, wherein said spiked rod has a foam spacer secured about said rod.

10. A method according to claim 6, wherein said arrow shaft has fletching attached to said distal end of said shaft, wherein said fins are aligned with said fletching to promote proper flight of said arrow.

* * * * *